United States Patent [19]

Kutz et al.

[11] Patent Number: 4,497,193

[45] Date of Patent: Feb. 5, 1985

[54] GRIPPING HEAD OF AN HYDRAULIC SHEET STRETCHER

[75] Inventors: Heinrich Kutz, Neuss; Dietrich Grube, Ratingen-Tiefenbroich; Georg Eggert, Hilchenbach-Dahlbruch; Rolf Stein, Hilchenbach, all of Fed. Rep. of Germany

[73] Assignee: SMS Schloemann-Siemag Aktiengesellschaft, Dusseldorf, Fed. Rep. of Germany

[21] Appl. No.: 360,466

[22] Filed: Mar. 22, 1982

[30] Foreign Application Priority Data

Mar. 26, 1981 [DE] Fed. Rep. of Germany ..... 3111880

[51] Int. Cl.[3] ..... B21D 25/04

[52] U.S. Cl. ..... 72/302; 72/301

[58] Field of Search ..... 72/302, 295, 290, 301, 72/311; 254/29 A

[56] References Cited

U.S. PATENT DOCUMENTS

| | | | |
|---|---|---|---|
| 2,727,556 | 12/1955 | Albers | 72/302 |
| 2,908,316 | 10/1959 | Albers | 72/302 |
| 3,082,809 | 3/1963 | Petsch et al. | 72/302 |
| 3,575,031 | 4/1971 | Gray | 72/302 |

FOREIGN PATENT DOCUMENTS

| | | | |
|---|---|---|---|
| 1075672 | 7/1967 | United Kingdom | 72/302 |

*Primary Examiner*—Daniel C. Crane

*Attorney, Agent, or Firm*—Holman & Stern

[57] ABSTRACT

A gripping head (1) comprises a plurality of vertical, spaced laminae (3) defining a gripping aperture (4) for gripping a sheet (7) to be stretched. The laminae (3) are welded at one edge to flanges of a horizontal cross member. In order to facilitate the welding, and to reduce the stress concentration factor at the weld, fillers (11) are arranged between the laminae at the said edge and the weld is a butt weld (13). After welding, the ends of the fillers (11) at the weld seam (13) are bored out (18) to remove cracks, or gaps (16, 17) between the fillers (11) and the laminae (3).

6 Claims, 7 Drawing Figures

GRIPPING HEAD OF AN HYDRAULIC SHEET STRETCHER

BACKGROUND OF THE INVENTION

1. Field of the Invention

The invention relates to a gripping head of an hydraulic sheet stretcher of welded design, comprising a horizontal cross member and a series of vertical laminae welded thereto which form the gripping aperture of the gripping head.

2. Description of the Prior Art

As the thickness of the sheet to be stretched increases, the stresses in the gripping aperture, in which clamping jaws for holding the sheet to be stretched are disposed, become increasingly high, relative to the width of the sheet. This has led to the gripping aperture advantageously being made up of laminae of sheet metal. In addition, the entire gripping head represents a heavily loaded transverse beam which comprises a correspondingly constructed cross member.

The known manner of securing the laminae of the gripping aperture to the cross member is by inserting the laminae into the comb-like upper and lower flange of the cross member of the respective gripping head and by welding them together by fillet welds. In this comb-like design these fillet welds have a high stress concentration factor $K_t$ and are in the range of maximum tensile and bending stresses. Furthermore, these weld seams must be welded by hand. In order to be inserted into the comb-like flanges the laminae must be reduced in thickness at their ends.

BRIEF SUMMARY OF THE INVENTION

The object of the invention is thus to replace the arrangement of the weld seams, which is disadvantageous in terms of stresses, by a new system of securing the laminae to the cross members and, at the same time, substantially to reduce welding expenses.

This object is attained with the gripping head described above in that fillers are arranged on the lamina base in the interval between the laminae, and the laminae, together with the fillers, are joined to the flanges of the cross member by butt welding, and the roots of the gaps between the laminae and the fillers are bored out to a given diameter after welding.

In this way the disadvantage of the comb-like connection of the laminae to the cross member and welding by fillet welds with the unfavorable stress concentration factor $K_t$ is avoided and a butt weld is obtained which has a considerably more favorable stress concentration factor $K_t$ than a fillet weld. Since the fillers, however, which are interposed between the laminae and partially, like the laminae, enter the butt weld at their base, may still have gaps towards the outside, the roots of these gaps represent notches with a radius tending towards zero and having an increased notch impact strength and thus a high stress concentration factor $K_t$. For this reason the roots of these gaps or joints are removed by bores.

According to a further feature of the invention the diameter of the bore is approximately equal to or greater than the thickness of the fillers. In this way the fillers, which are necessary merely as constructional aids for forming a butt weld between the laminae on the one hand and the flanges of the cross member on the other, are partially or entirely removed by the boring process performed after the butt weld is produced.

Stress peaks resulting from the use of the fillers can no longer occur. One advantage of the bores now present lies in the fact that the weld seam may be inspected through the bores by a probe and, if necessary, may be reworked by means of reamers.

In a further development of the invention the butt weld seam between the flanges of the cross member on the one hand and the laminae and fillers on the other is produced by the electro-slag welding method. This method is considerably more efficient and economical than the manual welding method. This automatic welding method cannot be employed, however, in the case of welding in the manner of a comb. This electro-slag welding method requires that a welding gap of approximately 30 mm in width, which lies in one plane and is accessible for a welding machine, be formed between the parts to be joined. The interstices between the laminae are thus closed by fillers in order to produce this welding gap.

According to a further feature of the invention the butt weld seam between the flanges of the cross member on the one hand and the laminae and fillers on the other may be produced by manual welding.

BRIEF DESCRIPTION OF THE DRAWINGS

One example of the invention will now be described in greater detail with reference to the accompanying drawings, wherein.

DETAILED DESCRIPTION

Figure 1:
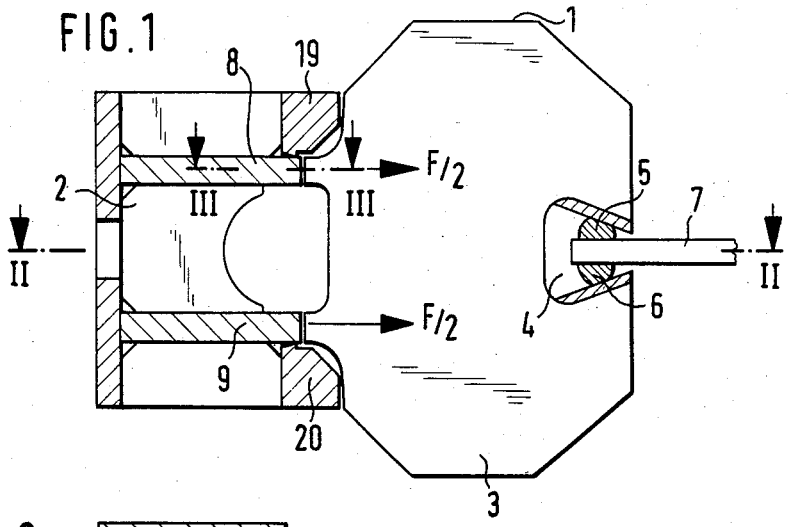
FIG. 1 is a cross-sectional side view showing the design of a gripping head of a sheet stretcher according to the invention.

FIG. 1 shows the basic design of a gripping head 1 of a sheet stretcher in side view. A cross member 2 of the gripping head 1 is joined to laminae 3. These laminae incorporate a gripping aperture 4, in which gripping jaws 5, 6 clamp a sheet 7 to be stretched. Horizontal flanges 8, 9, which are welded to the laminae, are provided in the cross member 2. In addition cross bars 19 and 20 are also provided.

Figure 2:
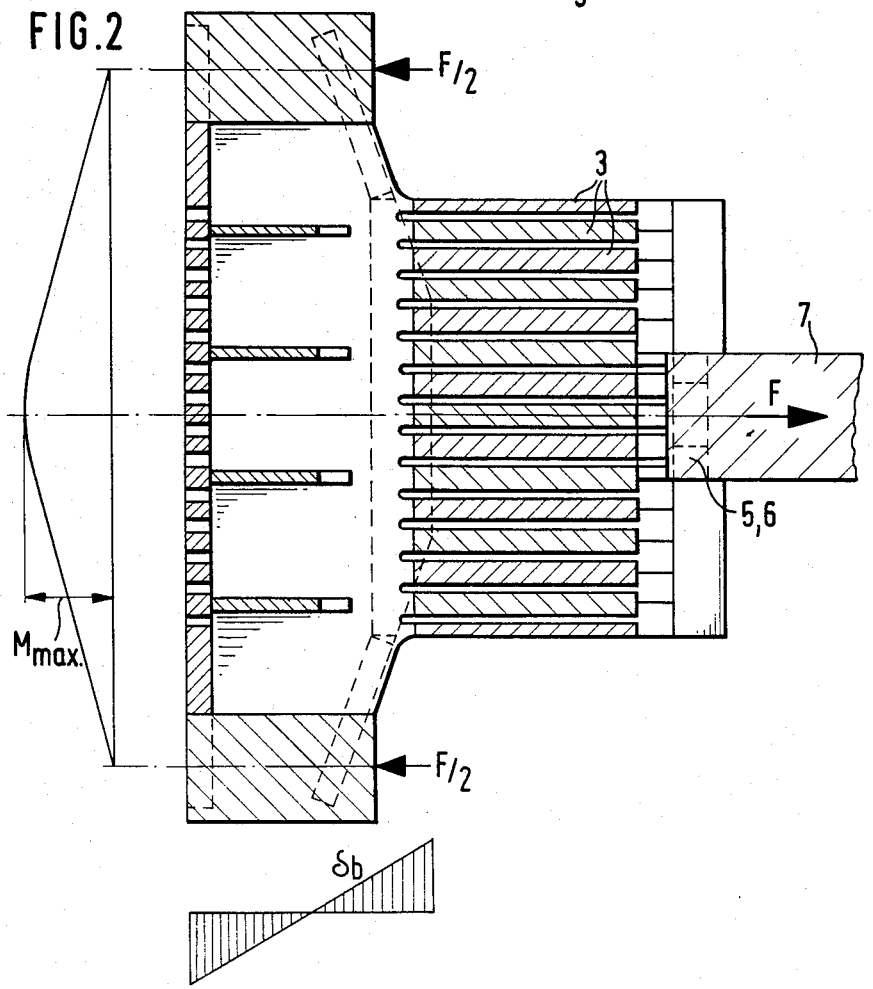
FIG. 2 is a horizontal cross-sectional view through the gripping head in the stretching plane taken along line II—II of FIG. 1.

FIG. 2 is a horizontal section through the gripping head 1 along the line II—II of FIG. 1, the laminae 3 holding the sheet 7 to be stretched in the gripping aperture 4 with the gripping jaws 5 and 6, and the laminae 3 being joined to the cross member 2. Of the stretching force F originating in the sheet 7, F/2 is absorbed in each case by the supports of the cross member 2. The characteristic which occurs of the bending stresses $\delta_b$ through the cross member 2 is shown as well as the moment characteristic $M_{max}$ over the stressed cross section.

Figure 3:
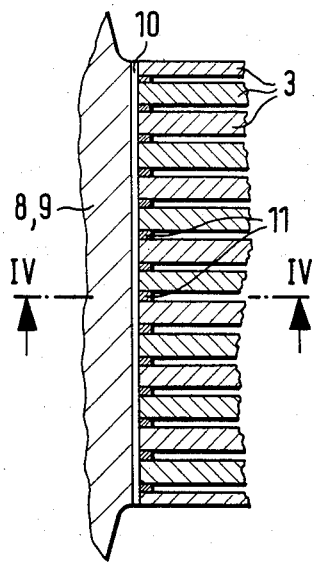
FIG. 3 is a horizontal cross-sectional view of the arrangement of the laminae and fillers in relation to the cross member of the sheet stretcher before welding taken along line III—III of FIG. 1.

FIG. 3 is a horizontal, cutaway section along the line III—III of FIG. 1 of the flanges 8 and 9, the laminae 3 with fillers 11 interposed between them and the welding gap 10 prepared between the flanges 8, 9 and the laminae 3.

Figure 4:
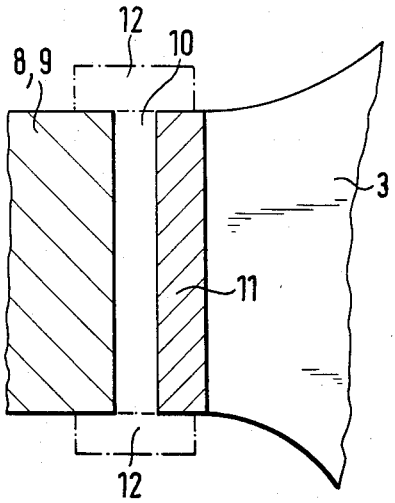
FIG. 4 is a cross-sectional view on an enlarged scale of a flange and filler with a welding gap before welding taken along line IV—IV of FIG. 3.

FIG. 4 is a section on an enlarged scale along the line IV—IV of FIG. 3 through the flanges 8, 9 and fillers 11 with the welding gap 10 lying between them for a butt weld seam. Water-cooled copper strips 12 are provided above and below the welding gap 10.

Figure 5:
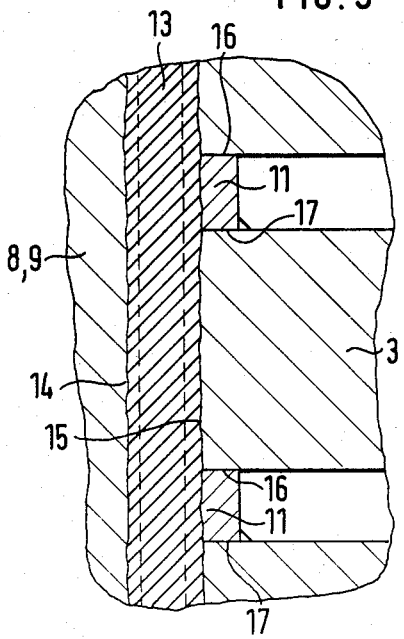
FIG. 5 is a cross-sectional view showing a cutaway portion of FIG. 3 on an enlarged scale with a flange, laminae and fillers after welding the butt weld seam.

FIG. 5 is a cutaway portion on an enlarged scale from FIG. 3 with the fillers 11 attached between the laminae 3 and the weld seam 13 after the welding process between the laminae 3 and the flanges 8 and 9 has been carried out. The original welding gap 10 is shown here in broken lines, while the penetration limits 14 and 15 of the weld seam 13 on the flanges 8, 9 and the laminae 3 show to what extent these parts have themselves fused with the weld metal. The foot of the fillers 11 is also fused therewith.

Figure 6:
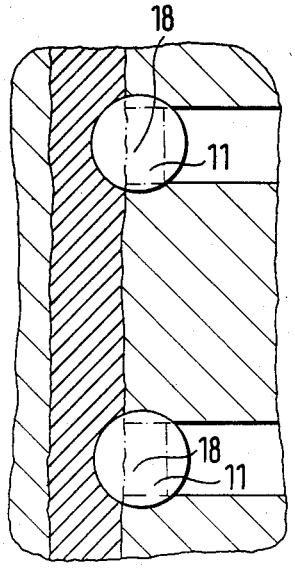
FIG. 6 is a view similar to FIG. 5, but after welding the butt weld seam and boring out the filler.
Figure 7:
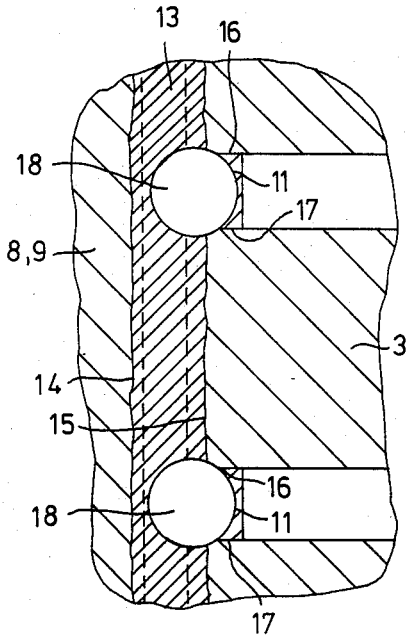
FIG. 7 is a view similar to FIG. 6 showing the embodiment wherein only part of the filler is bored out.

FIGS. 6 and 7 show the welding joint as in FIG. 5, but after the boring out process, FIG. 7 showing only partial boring of the filler. In this process bores 18, the diameter of which is equal to or greater than the fillers 11, are made in the region of the fillers 11. In this way the roots of the gaps 16, 17 between the fillers 11 and the laminae 3 on the penetration limit 15 are removed. The roots represent notches with a radius tending towards zero and are practically cracks which could open up further as a result of the bending stress occurring during the stretching process. The bores 18 at this point ensure a complete removal of these joints and thus the elimination of the danger of cracks. Furthermore, the surface of the weld seam may be inspected through the bores 18 by means of insertable probes.

We claim:

1. A gripping head of an hydraulic sheet stretcher comprising a cross member, at least one flange on said cross member, a plurality of spaced laminae extending substantially perpendicular to each flange defining a gripping opening at one edge thereof for gripping the sheet and positioned at the opposite edge thereof adjacent each flange to define spaces between adjacent laminae adjacent said opposite edge thereof, a butt weld seam connecting the laminae to each flange and extending between the spaced laminae at said spaces defined between adjacent laminae adjacent said opposite edge and concave circular curved surfaces within the butt weld seam extending at least between the adjacent laminae at said defined spaces and facing said defined spaces, said curved surfaces serving to remove cracks and notches adjacent said defined spaces.

2. A gripping head according to claim 1, wherein the diameter of the circular concave surfaces is approximately equal to or greater than the spacing between adjacent laminae.

3. A gripping head according to claim 1, wherein said butt weld seam is an electro-slag weld seam.

4. A gripping head according to claim 1, wherein the butt weld seam is a manual weld seam.

5. A gripping head according to claim 1 wherein two spaced flanges are provided on said cross member.

6. A gripping head according to claim 2 wherein two spaced flanges are provided on said cross member.

* * * * *